US005104496A

United States Patent [19]

Dupree

[11] Patent Number: 5,104,496

[45] Date of Patent: Apr. 14, 1992

[54] LOW MIST CHROMIUM PLATING METHOD AND SYSTEM

[75] Inventor: Don Dupree, Alta Loma, Calif.

[73] Assignee: Optical Radiation Corporation, Azusa, Calif.

[21] Appl. No.: 600,023

[22] Filed: Oct. 18, 1990

[51] Int. Cl.[5] ..... C25D 3/04; C25D 21/04; C25D 21/11; C25D 17/00

[52] U.S. Cl. ..... 205/94; 204/228; 204/277; 204/278; 204/130

[58] Field of Search ..... 204/277, 278, DIG. 1, 204/228, 51, 130

[56] References Cited

U.S. PATENT DOCUMENTS 1,344,030 6/1920 Greenawalt ..... 204/277 X
2,439,491 4/1948 Schiffl ..... 204/227
2,913,377 11/1959 Brown ..... 204/DIG. 1
4,411,760 10/1983 Guerriero et al. ..... 204/DIG. 1
4,425,197 1/1984 Inoue ..... 204/278 X
4,592,819 6/1986 Suzuki et al. ..... 204/277 X

*Primary Examiner*—Donald R. Valentine
*Attorney, Agent, or Firm*—Christie, Parker & Hale

[57] ABSTRACT

A low mist chromium plating system is disclosed which comprises a closed plating tank containing chromium plating solution preferably covered by a layer of mist suppressing foam. Nitrogen carrier gas is introduced into the plating tank above the plating solution and carries chromium mist to a series of aqueous traps. The first trap contains sodium bisulfite for reducing hexavalent chromium ions to trivalent chromium ions. The last trap contains 1,5-diphenylcarbohydrazide for indicating the presence of hexavalent chromium.

18 Claims, 2 Drawing Sheets

LOW MIST CHROMIUM PLATING METHOD AND SYSTEM

FIELD OF THE INVENTION

This invention relates to the field of chromium plating and more particularly to a low mist chromium plating system.

BACKGROUND OF THE INVENTION

Chromium plating is often used to provide a hard, durable, corrosion resistant and/or decorative finish to a platable substrate. Such plating typically involves the use of a chromic acid plating solution from which chromium is deposited on to a cathodic substrate as a result of an electrolytically induced oxidation-reduction reaction.

During the plating process, there is evolution of hydrogen gas at the anode and oxygen gas at the cathode, i.e., the substrate. The evolution of these gases carries a fine spray or mist of chromium plating solution into the atmosphere around the plating tank. Contact with the chromic acid mist may cause severe irritation to the mucous membranes and/or skin lesions. Moreover, chromium has been identified as a suspected carcinogen.

A variety of methods have been developed to deal with the mist generated during chromium plating. Such methods include collecting the mist above the tanks using fume hoods, then scrubbing the mist with various types of fume scrubbers. However, there is a great volume of air around the plating tank which contains the mist. Some mist remains uncollected and untreated by conventional methods and escapes into the atmosphere.

Accordingly, there is a need for a simple, more efficient way to reduce the amount of chromium mist which escapes to the atmosphere during chrome plating.

SUMMARY OF THE INVENTION

The present invention provides methods and apparatus particularly applicable for use in chrome plating to substantially eliminate the escape to the atmosphere of chromium plating solution mist.

The method comprises immersing a substrate to be plated into a plating tank containing metal plating solution and at least one anode. A mist suppressant foam preferably overlies the plating solution. The tank is then sealed to prevent escape to the atmosphere of plating solution mist during electrodeposition. A cover gas is introduced into the plating tank, passed over the plating solution and then out of the plating tank through a sealed line and into a first trap. The cover gas is bubbled through an aqueous solution contained in the first trap. Preferably the aqueous solution of the first trap contains an agent for precipitating metal ions in the plating solution mist carried by the cover gas to the first trap.

In a preferred embodiment of the invention, the method further comprises passing the cover as from the first trap to one or more additional traps and bubbling the cover gas through aqueous solutions contained therein. Preferably the solution of the last trap comprises a chemical indicator for indicating the presence of metal ions from the plating solution.

The apparatus of the present invention comprises a plating system which includes a plating tank containing plating solution, anodes, bus bars and the like as in conventional plating systems. An openable cover is provided to close over and seal the otherwise open top of the plating tank. Gas inlet and outlet lines are provided, preferably on opposite sides of the tank or cover, for passage of a cover gas, e.g., nitrogen, into and out of the plating tank once it is sealed. The inlet line is connected to a cover gas source.

The outlet line extends from the plating tank and becomes an inlet line to a first trap containing a first aqueous solution. The end of this first trap inlet line extends below the surface of the solution in the trap so that effluent gas from the plating tank will bubble through the aqueous solution of the first trap. Preferably, the first aqueous solution contains a precipitating agent to precipitate metal ions in any plating solution mist carried to the first trap by the cover gas.

In a preferred embodiment of the invention, the plating system comprises at least one additional trap containing an aqueous solution. All traps except for the last comprise closed containers. Each closed container has an outlet line which extends from a position above the solution level in that trap to a position below the solution level in the next trap. Preferably, the solution of the last trap comprises an indicator for indicating the presence of metal ions in the effluent gas bubbled therethrough.

DETAILED DESCRIPTION

In accordance with the present invention, there is provided a plating system for substantially reducing the escape to the atmosphere of mist generated by electroplating solutions. The invention is particularly applicable to chromium electroplating solutions. In fact, the present invention providing a means for eliminating up to 99.6% or more of the mist generated by a chromium plating solution as compared with a plating system having uncontrolled mist emissions.

Figure 1:
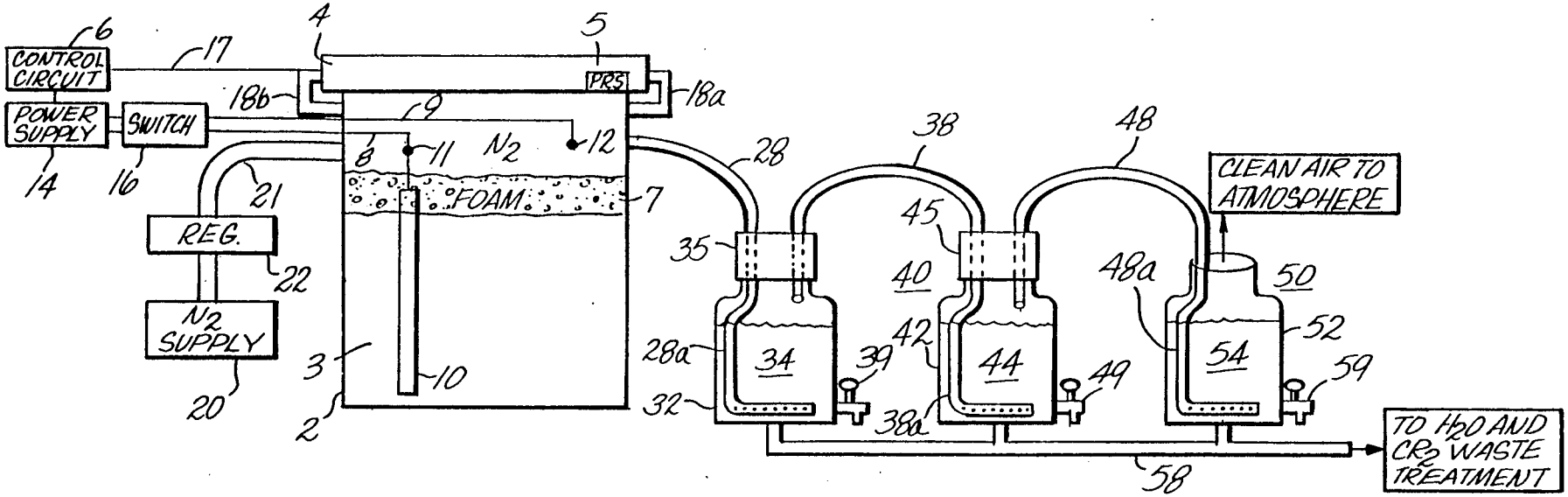
FIG. 1 is a schematic flow diagram of a first embodiment of a plating system according to the invention.

With reference to FIG. 1, there is shown a preferred plating system comprising a plating tank 2 having a cover 4 which can be closed over the open top of the plating tank 2 to seal the plating tank. The tank 2 contains plating solution 3, e.g., a chromic acid plating solution. In the embodiment shown, the tank is about 4 feet in width and length, and about 3 feet in height. It is understood that the size and shape of the plating tank is not critical. In the embodiment shown, a blanket of mist suppressant foam 7 covers the plating solution. Nitrogen gas 24 is passed over the foam 7.

It is understood that the invention is applicable to any conventional chromium plating solution. A presently preferred chromium plating solution 3 is Unichrome CR-180 manufactured by M & T Chemical Co. of Rahway, New Jersey. Although optional, any suitable mist suppressant may be used. A presently preferred mist suppressant for use with Unichrome CR-180 is Fumetrol 208 surfactant also manufactured by M & T.

One or more anodes 10 are positioned in the plating tank 2 and hang downwardly from an anodic buss barn into the plating solution A cathodic buss bar 12, from which plating racks carrying the substrate to be plated may be hung, is also provided. Electrical lines 8, 9 connect the anodic and cathodic buss bars 10 and 12 to a power supply 14, such as a D.C. power supply of 500-Amp.

There is provided a latch means 18 for releasably locking the cover 4 onto the top of tank 2. The latch means 18, preferably comprises electrically activatable time release locks which will not open until activated at a predetermined time, e.g., one hour after plating elapsed, thereby avoiding accidental escape of mist. In the embodiment shown, the latch means 18 is electrically connected to the power supply 14 via a control circuit 6. The circuit 6 detects when the predetermined time has passed after the power has been turned off, and actuates the latch means 18 at that time to allow the cover 4 to be opened.

Nitrogen cover gas is introduced into the plating tank 2 above the plating solution through a line 21 connected to a supply tank 20 via a regulator 22. Preferably, the nitrogen in the plating tank is contained at about 2 psi which is detected by a pressure sensor 5. The sensor 5 is electrically connected to the control circuit 6, so that the power supply 14 cannot be activated unless a particular pressure, e.g., 2 psi, is detected. If desired, the control circuit 6 may be arranged to detect premature opening of cover 4 and to activate an alarm. Suitable pressure sensitive mechanisms and circuitry for the control circuit 6 are within the ambit of those of ordinary skill in the art. For example, the pressure sensor 5 may be connected with the circuit 6 and a pressure switch relay 16 that does not allow current to pass from the power source 14 to the plating tank until detection of proper pressure on the sensor 5.

First outlet line 28 carries the effluent gas from the plating tank, i.e., the nitrogen cover gas along with chromium mist and hydrogen and oxygen gas evolved in the plating process, to a first trap 30. The first trap 30 contains a solution of sodium bisulfate in a concentration of about 10 grams/liter and maintained at a pH of about 2 to 3 with sulfuric acid. Line 28 extends into the solution 34 contained in trap 30. The submerged portion of line 28 contains perforations so that the effluent gas bubbles through the solution. The sodium bisulfite in the solution reacts with and reduces hexavalent chromium ions to trivalent chromium ions which then form $Cr_2(SO_4)_3$ which precipitates at a pH of 2 to 3.

Effluent gas from the first trap 30 passes into a second trap 40 through a second outlet line 38. Second outlet line 38 extends from a position above the solution level in the first trap 30 into any aqueous solution, e.g., deionized water maintained at pH 6 with sulfuric acid, contained in a second trap 40. End portion 38*a* of the second outlet line 38 is submerged in the solution 44 and contains perforations so that the effluent gas from the first trap bubbles through the solution of the second trap.

Effluent gas from the second trap is passed through a third outlet line 48 to a third trap 50. Again, the third outlet line 48 extends from a position above the solution level in the second trap 40 to a position under in the solution 54 in the third trap 50.

The first and second traps 30 and 40 are closed, each being formed by respective containers 32 and 42 and sealed with caps 35 and 45. Outlet lines 28 and 38 pass through and are sealed to the caps 35 and 45. The final trap 50 comprises a container 50, but no cap. This allows gas which has bubbled through the solution in the final trap to escape to the atmosphere.

In the embodiment shown, containers 32, 42, and 50 each have a capacity of about 20 liters and outlet lines 28, 38 and 48 have a diameter of about 0.375 inch with about 85 perforations, each having a diameter of 0.020 inch at the end of the lines. It is understood that the size of the containers and outlet lines as well as the presence and number of perforations in the outlet lines is a matter of choice.

The caps 35 and 45 of traps 30 and 40 may be provided with fill spigots 37 and 47 for introducing chemicals to the traps 30 and 40. Each container 32, 42 and 52 may be provided with a drain spigot 39, 49 and 59, respectively, for draining the contents of the trap. A line 58 may also be provided for receiving waste water from the containers 32, 42, 52 containing trivalent chromium ions for disposal thereof by treatments well known to those of ordinary skill in the art.

The presence and amount of hexavalent chromium in the gas bubbling through the last trap 50 may be determined using the 1, 5-diphenylcarbohydrazide method. Use of a single dry powder formulation, such as Chroma Ver 3 Chromium Reagent manufactured by Hatch Co. in Loveland, Colorado is presently preferred. This reagent contains a buffer combined with the 1, 5-diphenylcarbohydrazide which reacts to yield a purple color when hexavalent chromium is present. The method is applicable to both fresh water and waste water samples. The amount of hexavalent chromium present is directly proportional to the depth of color. The lowest detection limit is about 1.5 mg/l.

Figure 2:
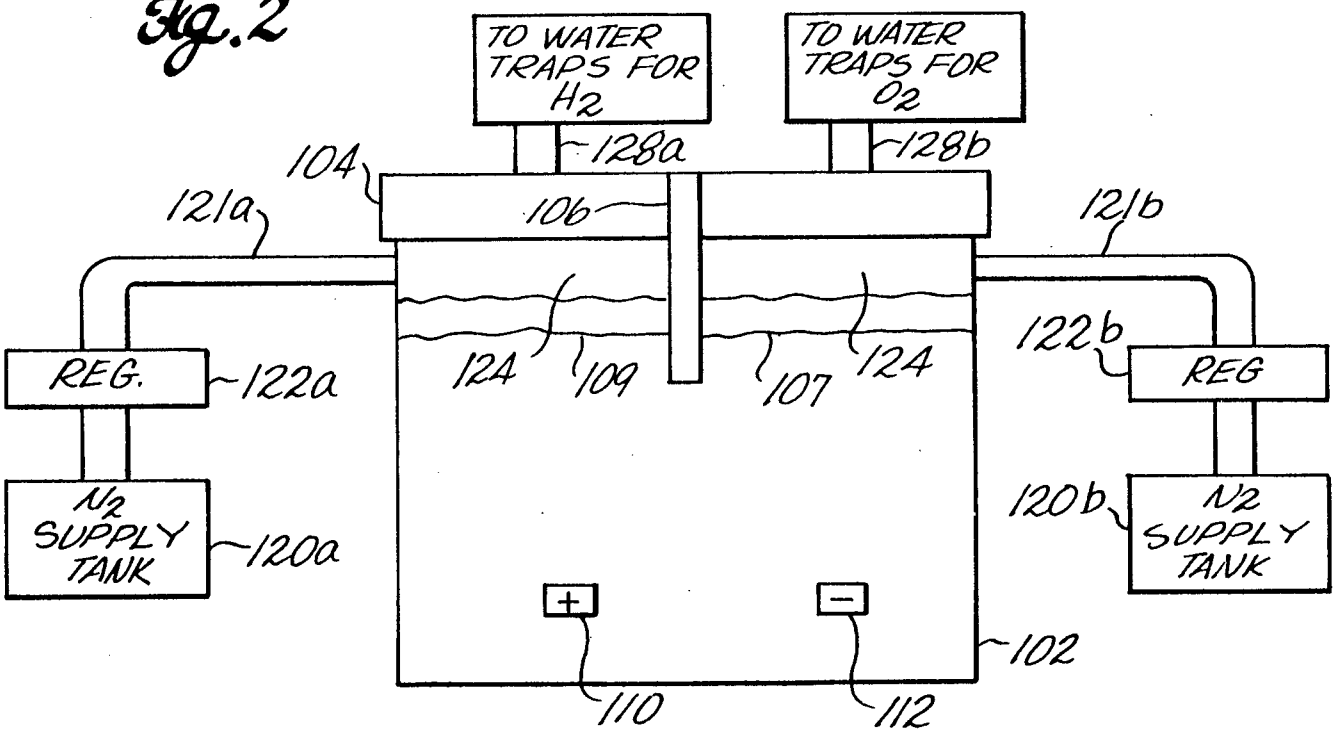
FIG. 2 is a schematic diagram of a second embodiment of the plating system according to the invention.

In a variation of the embodiment of FIG. 1, the hydrogen and oxygen gas evolved during plating are maintained separately. This is done to reduce combustibility of the hydrogen gas. In this embodiment, as shown in FIG. 2, the tank 102 has a cover 104 having a divider 106 which extends downwardly into the tank 102 to a position just below the surface of the plating solution when the cover is sealed over the plating tank. The divider is located generally above the midpoint between the anodes and cathodes and divides the space above the plating solution into two chambers 110 and 112. In such an arrangement, hydrogen and oxygen gas evolving from the anode 110 and cathode 112, respectively, rise through the plating solution into separate chambers separated by the divider 106. Nitrogen cover gas is introduced into each chamber 110 and 112 through separate lines 122*a* and 122*b*. As in the previous embodiment, there is preferably a foam mist suppressant layer 124 over the plating solution.

For each chamber 110 and 112, there is an outlet line 128*a*, 128*b* and separate sequences of traps. The outlet lines 128*a*, 128*b* and traps in each sequence are generally the same as those in the first embodiment. Thus, there are three traps associated with chamber 110 and three traps associated with chamber 112.

The invention has been described above with references to the preferred embodiments shown in the drawings. It is understood, however, that many changes and alterations may be made without departing from the scope of the invention.

For example, the illustrated embodiments show three traps in sequence. It is understood that more or less can be used. It is also possible to omit the foam layer 7, although more mist will need to be treated in the traps. It is also understood that, while it is desirable to provide a control circuit to prevent premature opening of the plating tank cover or premature activation of the power supply, those functions, i.e., opening of the plating tank and activation of the power supply, may be performed manually.

The system is of the present invention may be used with any electroplating bath, but is particularly applicable to those electroplating baths which generate a large amount of plating solution mist. With respect to chromium plating baths, it is applicable to both hard plating and decorative chrome plating.

Although the first and second embodiments of the low mist chromium plating system are disclosed in connection with plating systems that are not part of an automated line, the above-described invention is equally applicable to such automated plating systems.

As noted, the plating system according to the invention is a closed system in contrast to previous open systems. This closed system uses a carrier gas, such as nitrogen, to carry oxygen and hydrogen, separately or together, along with chromium plating solution mist, through a series of closed traps. The traps may simply contain water. More preferably, one or more traps contain chemicals to precipitate or to oxidize or reduce the metal plating ions to a safe or less toxic form. In the case of chromium, it is preferred that one or more traps contain agents to safely reduce the hexavalent chromium to the relatively nontoxic trivalent form and to precipitate the trivalent chromium. This closed plating system vastly reduces the chromium mist which escapes to the atmosphere and vastly reduces the amount of gas containing the mist which must be treated. It results in a safe, economical and efficient system for low mist chromium plating.

The above-described embodiments of the plating system according to the present invention are intended merely as illustrations thereof, and could be read consistent with and as support for the following claims which are to have their fullest scope.

What is claimed is:

1. A plating system for reducing the amount of plating solution mist escaping into the atmosphere comprising:

a plating tank for containing a metal plating solution and at least one anode;

a cover for removably sealing the plating tank;

means for establishing a current between a cathode and an anode submersed in a plating solution contained in the plating tank;

means for introducing a carrier gas into the sealed plating tank above a plating solution contained in the plating tank;

a first aqueous trap comprising a container for containing an aqueous rinse;

means for passing carrier gas and plating solution mist from the sealed plating tank to the trap and for bubbling said carrier gas and plating solution mist through aqueous rinse contained in said trap; and means for preventing current from passing between a substrate and anode submerged in a plating solution contained in the plating tank unless the plating tank is covered and sealed.

2. A plating system as claimed in claim 1 further comprising a second aqueous trap comprising a container for containing an aqueous rinse and means for passing effluent gas from the first aqueous trap to the second aqueous trap and for bubbling said effluent gas through an aqueous rinse contained in said second aqueous trap.

3. A plating system for reducing the amount of plating solution mist escaping into the atmosphere comprising:

a plating tank for containing a metal plating solution and at least one anode;

a cover for establishing a current between a cathode and an anode submersed in a plating solution contained in the plating tank;

means for introducing a carrier gas into the sealed plating tank above a plating solution contained in the plating tank;

a first aqueous trap comprising a container for containing an aqueous rinse;

means for passing carrier gas and plating solution mist from the sealed plating tank to the trap and for bubbling said carrier gas and plating solution mist through an aqueous rinse contained in said trap; and means for preventing the opening of the cover for a predetermined period of time after the passage of current between an anode and cathode submerged in plating solution contained in the plating tank.

4. A method for reducing the amount of plating solution mist escaping into the atmosphere comprising:

providing a plating tank containing a metal plating solution and at least one anode;

immersing a substrate to be plated into the plating solution;

covering and sealing the plating tank with a removable cover;

establishing a current between the substrate and the anode to thereby electrolytically deposit metal onto the substrate for a select period of time;

introducing a carrier gas into the covered plating tank above the surface of the plating solution;

passing carrier gas containing mist of the plating solution from the plating tank to an aqueous rinse and bubbling said carrier gas containing mist of the plating solution through the aqueous rinse; and covering the plating solution with a mist suppressing foam.

5. A method as claimed in claim 4, wherein the plating solution is a chromium plating solution.

6. A method as claimed in claim 4, wherein the aqueous rinse comprises sodium bisulfite.

7. A method as claimed in claim 4, wherein the carrier gas is nitrogen.

8. A method as claimed in claim 4, wherein the tank is pressurized during plating.

9. A method as claimed in claim 8, wherein the pressure is about two psi.

10. A method as claimed in claim 4, wherein the carrier gas which bubbles through the aqueous rinse is passed to a second aqueous rinse and bubbled therethrough.

11. A method for reducing the amount of hexavalent chromium escaping into the atmosphere above a chromium plating solution comprising:

providing a plating tank containing a chromium plating solution and an anode;

immersing a substrate to be plated into the plating solution;

covering and sealing the plating tank with a removable cover;

establishing a current for a select period of time between the substrate and the anode to thereby electrolytically deposit chromium onto the substrate;

introducing a carrier gas into the covered plating tank over the surface of the plating solution; and passing carrier gas containing mist of the chromium plating solution from the plating tank to a first trap comprising aqueous solution containing a reducing agent for reducing hexavalent chromium ions to trivalent chromium ions and bubbling said carrier gas containing chromium mist through said aqueous solution.

12. A method as claimed in claim 11, wherein the carrier gas is nitrogen.

13. A method as claimed in claim 12 wherein the nitrogen carrier gas is introduced at a rate sufficient to produce a pressure within the plating tank of about 2 psi.

14. A method as claimed in claim 11 wherein the reducing agent is sodium bisulfite.

15. A method as claimed in claim 14 wherein the sodium bisulfite is present in a concentration of at least about 10 grams per liter.

16. A method as claimed in claim 11 wherein the first trap comprises a sealed container and wherein the method further comprises passing effluent gas from the first trap to at least one additional trap containing an aqueous solution, and bubbling said effluent gas through the aqueous solution in each such additional trap.

17. A method as claimed in claim 16 wherein the aqueous solution of the last additional trap comprises an indicator for indicating the presence of hexavalent chromium ions in the effluent gas bubbled therethrough.

18. A method as claimed in claim 17 wherein the indicator is 1,5-diphenylcarbohydrazide.

* * * * *

UNITED STATES PATENT AND TRADEMARK OFFICE

CERTIFICATE OF CORRECTION

PATENT NO. : 5,104,496

DATED : April 14, 1992

INVENTOR(S) : Don Dupree

It is certified that error appears in the above-identified patent and that said Letters Patent is hereby corrected as shown below:

Column 1, line 59, change "as" to -- gas --.

Column 2, line 65, after "solution" insert a period.

Column 5, line 54, after "through" insert -- an --.

Signed and Sealed this

Tenth Day of August, 1993

*Attest:*

Michael K. Kirk

MICHAEL K. KIRK

*Attesting Officer*

*Acting Commissioner of Patents and Trademarks*